US007962065B2

(12) United States Patent
Ukai

(10) Patent No.: US 7,962,065 B2
(45) Date of Patent: Jun. 14, 2011

(54) IMAGE FORMING APPARATUS

(75) Inventor: Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 385 days.

(21) Appl. No.: 11/838,962

(22) Filed: Aug. 15, 2007

(65) Prior Publication Data

US 2008/0044203 A1 Feb. 21, 2008

(30) Foreign Application Priority Data

Aug. 21, 2006 (JP) ..... 2006-224328

(51) Int. Cl.
*G03G 15/16* (2006.01)

(52) U.S. Cl. ..... 399/122; 399/167; 399/330

(58) Field of Classification Search ..... 399/75, 399/107, 111, 116, 117, 119, 122, 159, 167, 399/320, 328, 330
See application file for complete search history.

(56) References Cited

U.S. PATENT DOCUMENTS

| | | | | |
|---|---|---|---|---|
| 4,498,757 | A * | 2/1985 | Lance et al. | 399/332 |
| 5,592,273 | A * | 1/1997 | Yamamoto | 399/126 |
| 5,634,178 | A | 5/1997 | Sugiura et al. | |
| 5,768,656 | A * | 6/1998 | Nagasue et al. | 399/75 |
| 5,845,175 | A * | 12/1998 | Kumar et al. | 399/111 |
| 6,101,354 | A * | 8/2000 | Nakagawa et al. | 399/225 |

FOREIGN PATENT DOCUMENTS

| | | | |
|---|---|---|---|
| JP | 5-45313 | U | 6/1993 |
| JP | 6-314001 | A | 11/1994 |
| JP | 2000-267500 | A | 9/2000 |
| JP | 2000-291781 | A | 10/2000 |
| JP | 2001-92294 | A | 4/2001 |
| JP | 2000-291781 | A | 10/2001 |
| JP | 2005-016587 | A | 1/2005 |
| JP | 2005-195080 | A | 7/2005 |
| JP | 2006-163305 | A | 6/2006 |

OTHER PUBLICATIONS

Decision of Final Rejection mailed Feb. 17, 2009 in Japanese Application No. 2006-224328 and English translation thereof.
JP Office Action dtd 2008-07-158, JP Appln. 2006-224328 (partial translation).

* cited by examiner

*Primary Examiner* — David P Porta
*Assistant Examiner* — Benjamin Schmitt
(74) *Attorney, Agent, or Firm* — Banner & Witcoff, Ltd.

(57) ABSTRACT

An image forming apparatus includes first and second intermediate gears configured to transmit a driving force to a heat roller gear. The first and second intermediate gears are removably assembled to a body frame of the image forming apparatus in an installation space defined in the body frame. When a fixing unit is removed from the body frame, the installation space is open and the first and second intermediate gears can be attached to and removed from the body frame.

19 Claims, 10 Drawing Sheets

IMAGE FORMING APPARATUS

CROSS REFERENCE TO RELATED APPLICATION

This application claims priority from Japanese Patent Application No. 2006-224328, filed on Aug. 21, 2006, the entire subject matter of which is incorporated herein by reference.

FIELD

Aspects of the invention relate to an image forming apparatus and, more particularly to, an electrophotographic image forming apparatus.

BACKGROUND

In an image forming apparatus such as a laser printer, various kinds of rollers that rotate along with a feeding operation of a recording medium such as a sheet of paper (hereinafter referred to as a recording sheet) are disposed. Of these rollers, for example, a heat roller that is configured to heat a developing agent image transferred onto a recording sheet receives a driving force via a gear train composed of gears.

The image forming apparatus is generally provided with a body frame. The body frame includes side frames disposed on both sides of the image forming apparatus, with respect to a width direction, which is horizontal to a direction perpendicular to a sheet feeding direction. In a space defined between the side frames (hereinafter referred to as an installation space), an image forming device including a fixing unit and process cartridges is detachably attached to the side frames.

Gear trains are assembled on the outside of the body frame as opposed to the inside of the body frame where the installation space is defined. The outside of the body frame is covered with a cover plate so as to protect the gear trains.

The outside of the cover plate is covered with a design cover (or a housing) that provides the cosmetic appearance of the image forming apparatus. Circuit boards such as a control circuit board and a power circuit board are disposed between the cover plate and the body frame.

Thus, if a gear that drives the heat roller is greatly worn or damaged and needs replacing, the design cover should be removed to remove the cover plate and the circuit boards before replacing the gear.

After replacing the gear, the cover plate and the circuit boards are assembled to the body frame, and then the design cover is assembled to the body frame.

SUMMARY

Aspects of the invention may provide an improvement in maintenance of gears that transmit a driving force to a rotating member such as a heat roller.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. The image forming apparatus according to aspects of the invention is applied to a laser printer in this embodiment. It will be appreciated that aspects of the invention apply to other types of image forming apparatuses as well.

An appearance of a laser printer 1 will be now described.

Figure 1:
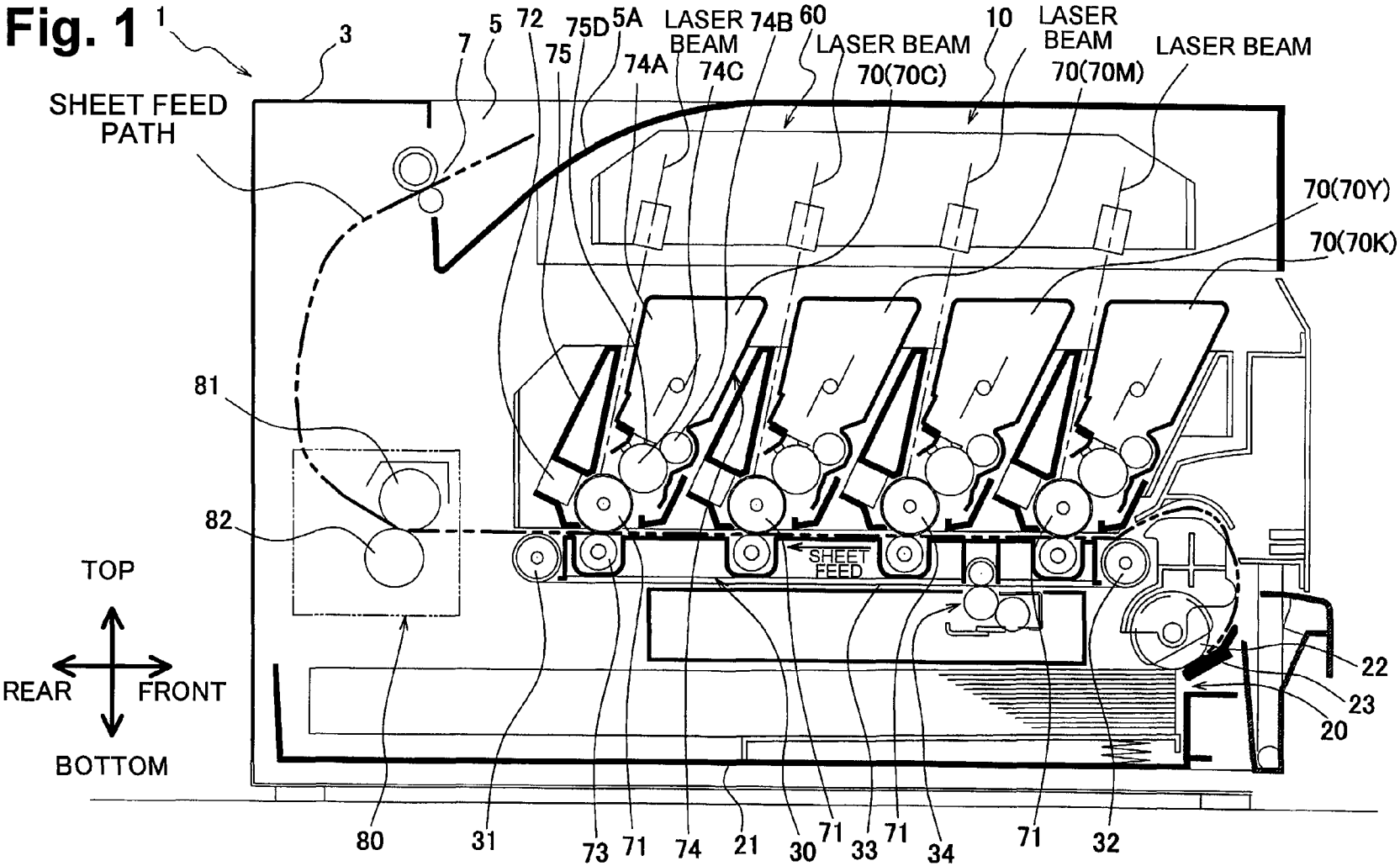
FIG. 1 is a side sectional view showing a main part of a laser printer according to an illustrative embodiment of the invention.

In the following description, an upper side of FIG. 1 is referred to as the top of a laser printer 1, and a lower side of FIG. 1 is referred to as the bottom of the laser printer 1. The right side of FIG. 1 is referred to as the front side of the laser printer 1 and the left side is referred to as the rear side of the laser printer 1.

The laser printer 1 is covered with a housing 3 that is a design cover that provides the cosmetic appearance of the laser printer 1. On the top of the housing 3, a sheet ejection tray 5 is provided. Recording sheets such as plain paper or a transparency, which have undergone a printing process, are ejected from the housing 3 and received on the sheet ejection tray 5.

The sheet ejection tray 5 includes an inclined surface 5A that is inclined down from the top surface of the housing 3. At a rear end of the inclined surface 5A, an ejection portion 7 is provided. A recording sheet that has undergone a printing process is ejected out from the ejection portion 7.

An internal structure of the laser printer 1 will be described.

The laser printer 1 includes an image forming portion 10, a feeder portion 20, and a belt unit 30. The image forming portion 10 functions as an image forming device that is configured to form an image onto a recording sheet. The feeder portion 20 functions as a part of a feeding device configured to supply a recording sheet to the image forming portion 10. The belt unit 30 functions as the feeding device configured to feed a recording sheet to four process cartridges 70K, 70Y, 70M, 70C made up of the image forming portion 10.

The recording sheet onto which an image has been formed at the image forming portion 10 is ejected from the ejection portion 7 onto the ejection tray 5 after its feeding direction is changed upward at an ejection chute (not shown).

The feeder portion 20 includes a sheet supply tray 21, a sheet supply roller 22, and a separation pad 23. The sheet supply tray 21 is disposed in the lowermost part of the housing 3, and is configured to hold a stack of recording sheets. The sheet supply roller 22 is disposed at an upper front end of the sheet supply tray 21, and is configured to supply or feed a recording sheet placed in the sheet supply tray 21 to the image forming portion 10. The separation pad 23 is disposed to face the sheet supply roller 22, and is configured to apply a resistance to a recording sheet to separate it from the stack of recording sheets in the sheet supply tray 21. The recording sheet stored in the sheet supply tray 21 is u-turned at the front of the housing 3, and fed to the image forming portion 10 disposed in a substantially middle portion of the housing 3.

The belt unit 30 includes a drive roller 31, a driven roller 32, a conveyor belt 33, and a belt cleaner 34. The drive roller 31 is configured to rotate along with an operation in the image forming portion 10. The driven roller 32 is spaced away from the drive roller 31 and is configured to rotate. The conveyor belt 33 is stretched between the drive roller 31 and the driven roller 32. The belt cleaner 34 is configured to remove developing agent adhering on a surface of the conveyor belt 33.

As the conveyor belt 33 rotates with a recording sheet placed thereon, the recording sheet supplied from the sheet supply tray 21 is fed to the four process cartridges 70K, 70Y, 70M, and 70C successively.

The image forming portion 10 includes a scanner unit 60, process cartridges 70, and a fixing unit 80.

The image forming portion 10 is of a direct tandem type, where color printing is possible. In this illustrative embodiment, the four process cartridges 70K, 70Y, 70M, and 70C corresponding to four developing agents or four color types of toner, black, yellow, magenta, and cyan, respectively, are arranged in line along a sheet feeding direction.

The scanner unit 60 is disposed in an upper portion of the housing 3, and is configured to form electrostatic latent images on corresponding surfaces of photosensitive drums 71 disposed in the four process cartridges 70K, 70Y, 70M, and 70C, respectively. The scanner unit 60 includes a laser light source, a polygon mirror, fθ lens and reflecting mirrors.

A laser beam emitted from the laser light source, based on image data, is deflected by the polygon mirror, passes through the fθ lenses, is folded by the reflecting mirror, is further bent downward by the reflecting mirror, and then directed to a surface of the photosensitive drum 71, on which an electrostatic latent image is formed.

The four process cartridges 70K, 70Y, 70M, and 70C are identical in structure except that they have different colors of developing agents, respectively. Thus, in the following description, the four process cartridges 70K, 70Y, 70M, and 70C are generally indicated by reference numeral 70, and the structure of the process cartridge 70 will be described based on the process cartridge 70C.

The process cartridge 70 is detachably disposed in a process casing 75, which is movably mounted to a main frame 100 under the scanner unit 60 in the housing 3. The process casing 75 includes a photosensitive drum 71, a charger 72, and a developing cartridge 74 inside.

The four process cartridges 70K, 70Y, 70M, and 70C are attached to and removed from the body frame 100 of the laser printer 1 by moving the process casing 75 in the sheet feeding direction or the front-rear direction of FIG. 1.

The photosensitive drum 71 is configured to carry an image, which is to be transferred onto a recording sheet. The photosensitive drum 71 is cylindrically shaped and its outermost layer is a positively charged photosensitive layer made of polycarbonate.

The charger 72 is configured to charge the surface of the photosensitive drum 71. The charger 72 is disposed away from the photosensitive drum 71, so as to face the photosensitive drum 71 diagonally rearward from above.

The charger 72 according to this illustrative embodiment is a scorotron charger that charges the surface of the photosensitive drum 71 substantially uniformly and positively by corona discharge from a charging wire made of tungsten and the like.

A transfer roller 73 is configured to transfer the developing agent adhering to the surface of the photosensitive drum 71 to a print surface of a recording sheet. Specifically, the transfer roller 73 is disposed so as to face the photosensitive drum 71 on the opposing side of the conveyor belt 33, and is configured to rotate along with rotation of the photosensitive drum 71 Also, the transfer roller 73 applies an electrical charge with polarity (a negative charge in this illustrative embodiment) opposite to an electrical charge charged to the photosensitive drum 71 to the recording sheet from a side opposite to the print surface when the recording sheet passes through the photosensitive drum 71.

The developing cartridge 74 includes a developing agent chamber 74A, a developing agent supply roller 74B, a developing roller 74C, and a layer thickness regulating blade 74D. The developing agent is stored in the developing agent chamber 74A. The developing agent supply roller 74B and the developing roller 74C are configured to supply the developing agent to the photosensitive drum 71. The layer thickness regulating blade 74D is configured to regulate the developing agent carried on the surface of the developing roller 74C to a thin layer having a uniform thickness.

The developing agent stored in the developing agent chamber 74A is supplied to the developing roller 74C along with the rotation of the developing agent supply roller 74B. The developing agent supplied to the developing roller 74C is carried on a surface of the developing roller 74C, regulated to a uniform thickness by the layer thickness regulating blade 74D, and then supplied to the surface of the photosensitive drum 71 that is exposed to light by the scanner unit 60.

The fixing unit 80 is disposed rearward from the photosensitive drum 71 in the sheet feeding direction, and is configured to melt the developing agent transferred onto the recording sheet by heat and fix it to the recording sheet. The fixing unit 80 is removable from the body frame 100.

The fixing unit 80 includes a heat roller 81 and a pressure roller 82. The heat roller 81 is disposed to face the print surface of a recording sheet, and is configured to give a feeding force to a recording sheet while heating the developing agent on the recording sheet. The pressure roller 82 is disposed to face the heat roller 81 over a recording sheet, and is configured to press against the heat roller 81.

The heat roller 81 receives a driving force transmitted from an electrical motor, not shown, via a gear mechanism, and rotates. The pressure roller 82 receives a rotational force from the heat roller 81 via a recording sheet that contacts the heat roller 81, and rotates.

Figure 2:
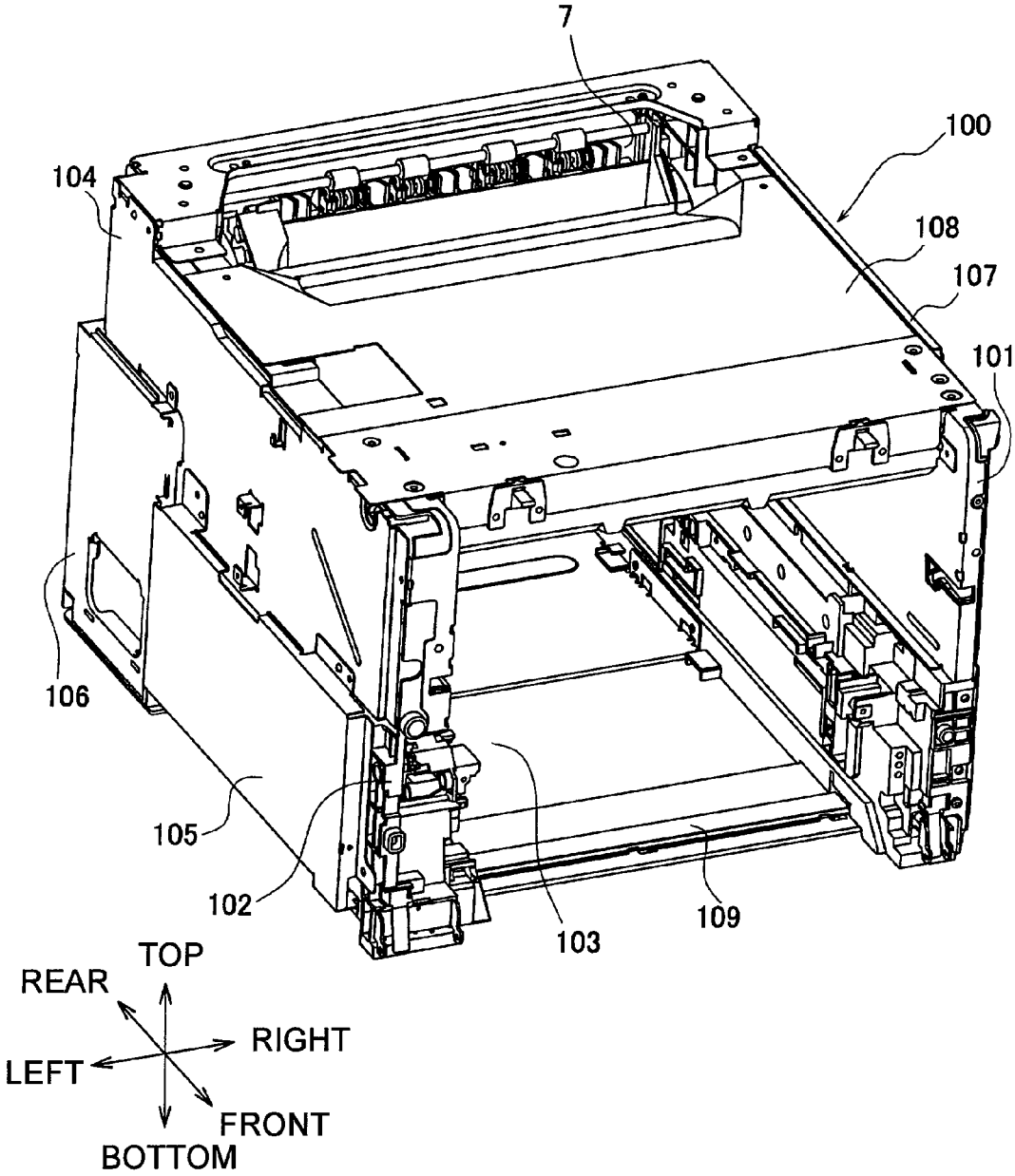
FIG. 2 is a left perspective view of a body frame of the laser printer.
Figure 3:
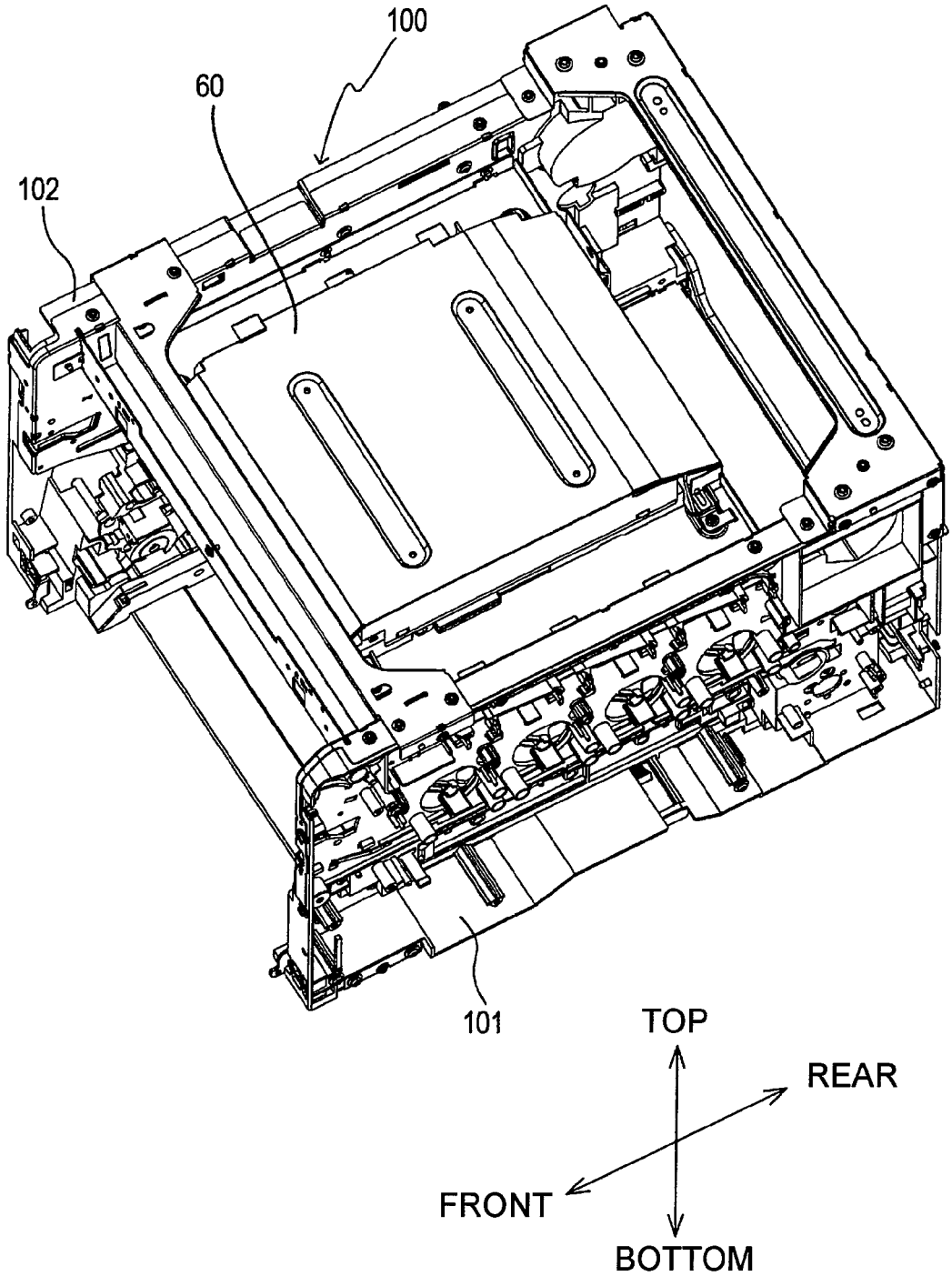
FIG. 3 is a top perspective view of the body frame of the laser printer from which a cover plate is removed.
Figure 4:
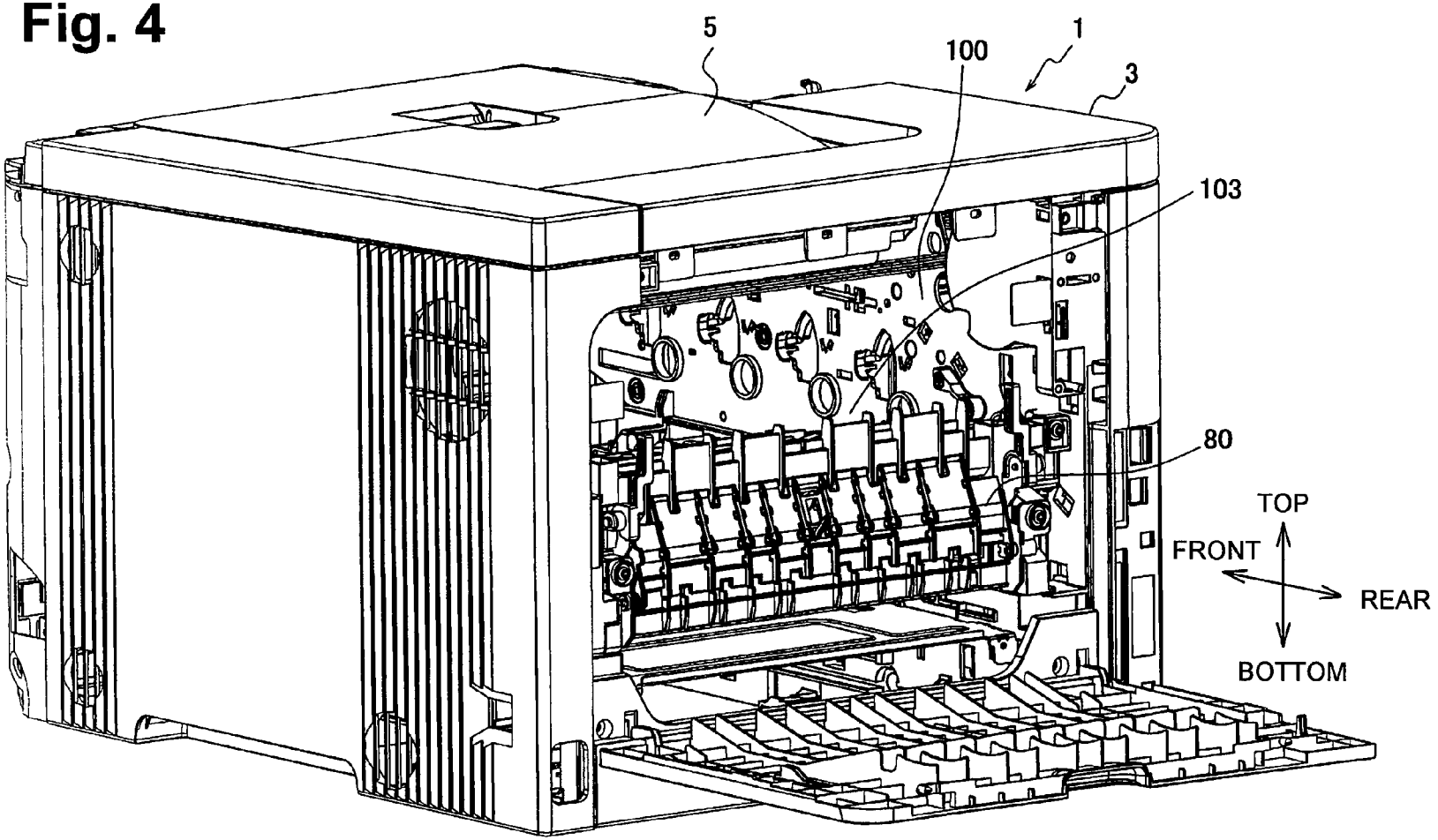
FIG. 4 is a perspective view of the body frame to which a fixing unit is attached.

As shown in FIG. 2, the body frame 100 includes a first body frame 101 and a second body frame 102 which are disposed opposite to each other on both sides in a width direction, which is horizontal to a direction perpendicular to the sheet feeding direction. The first body frame 101 and the second body frame 102 are shaped in the form of plates.

The image forming portion 10 including the fixing unit 80 and the process cartridges 70, and the belt unit 30 are detachably attached to the main frame 100 in a space provided between the first body frame 101 and the second body frame 102. The space is hereinafter referred to as an installation space 103.

The body frame 100 or the first and second body frames 101, 102 are made of a resin excellent in mechanical strength, such as PC, ABS, and polymer alloy. An electrical motor (not shown) that supplies a driving force to a rotating member such as the heat roller 81, and gears (not shown) that transmit the driving force generated in the electrical motor to the heat roller 81 are assembled to the body frame 100.

The electrical motor and the gears (hereinafter referred to as a gear train) are assembled to an opposite side of the body frame 100 to the installation space 103, that is, the outside of the body frame 100.

The outside of the body frame 100 is covered with cover plates 104 to 107 that are made of a metal such as cold rolled steel plate SPCC (JIS standard). The cover plates 104 to 107 are covered with the housing 3 (a cosmetic cover), which is made of a resin and provides the cosmetic appearance of the laser printer 1.

The cover plate 104 is configured to protect gear trains. The cover plate 105 is configured to protect the photosensitive drums 71 and engine control circuit board (not shown) that controls the electrical motor. The cover plate 106 is configured to protect a main control circuit board (not shown) that controls the laser printer 1. The cover plate 107 is configured to protect the first body frame 101.

The upper ends of the first and second body frames 101, 102 are connected to a top plate portion 108 made of a metal such as SPCC. The lower ends of the first and second body frames 101, 102 are connected to a bottom frame 109 made of a metal such as SPCC. Thus, the installation space 103 is defined in a substantially cubic shape and opens in the front-rear direction.

Figure 6:
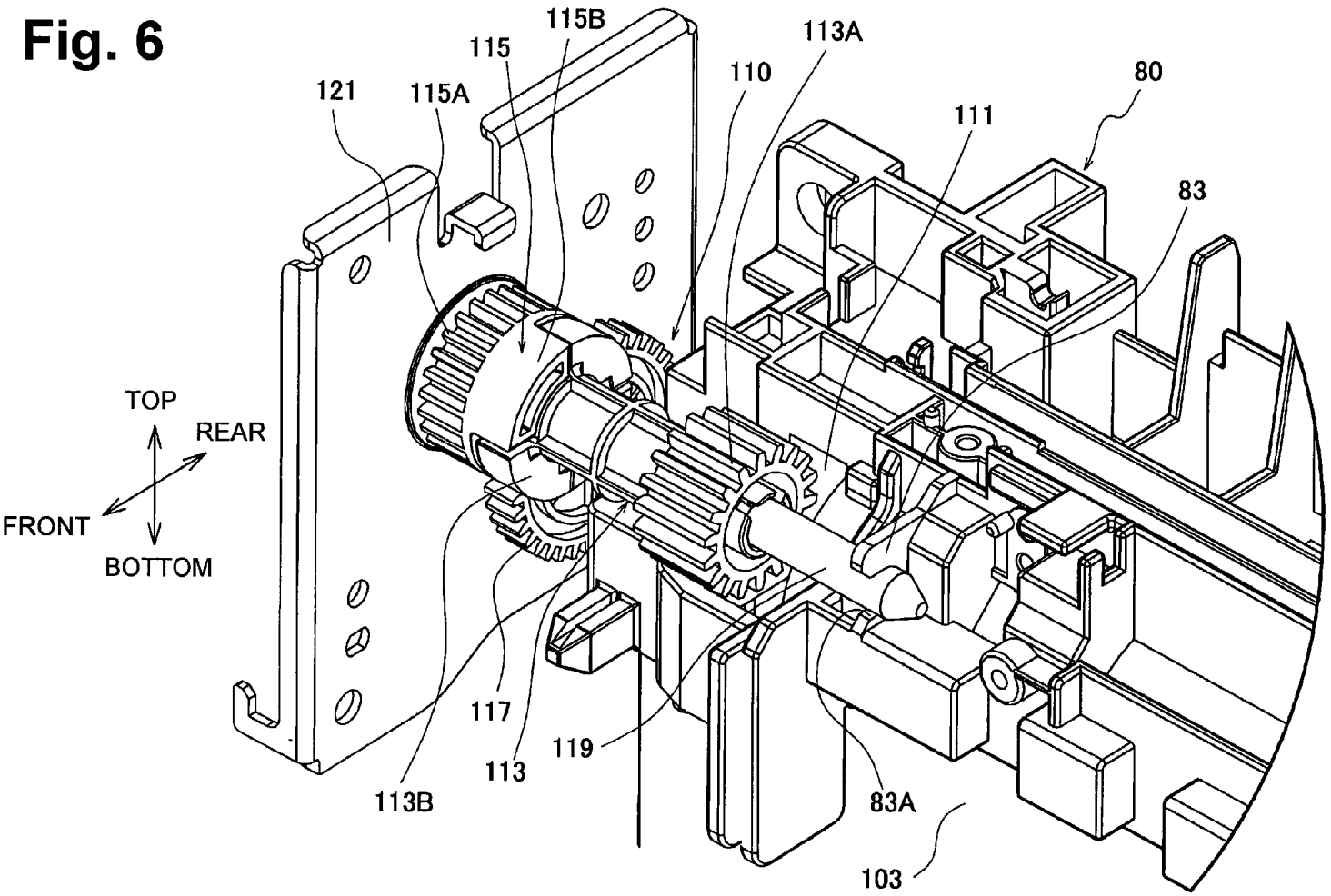
FIG. 6 is a perspective view of a gear mechanism that transmits a driving force to a heat roller.

A gear mechanism 110 will be described with reference to FIGS. 6 and 7. The gear mechanism 110 is a gear train that transmits a driving force from the electrical motor assembled to the body frame 100 to the heat roller 81. In FIG. 6, a heat roller gear 111 is disposed in the fixing unit 80, and is integral with a rotary shaft (not shown) of the heat roller 81 to rotate along therewith.

A first intermediate gear 113 is configured to transmit a driving force generated in the electrical motor to the heat roller gear 111 coupled to the heat roller 81. A second intermediate gear 115 is a coupling gear that is configured to transmit a driving force from a drive-side gear 117 to the first intermediate gear 113.

The drive-side gear 117 is rotatably assembled to the body frame 100, so that it receives a driving force from the electrical motor via the gear train and thus rotates.

Figure 8:
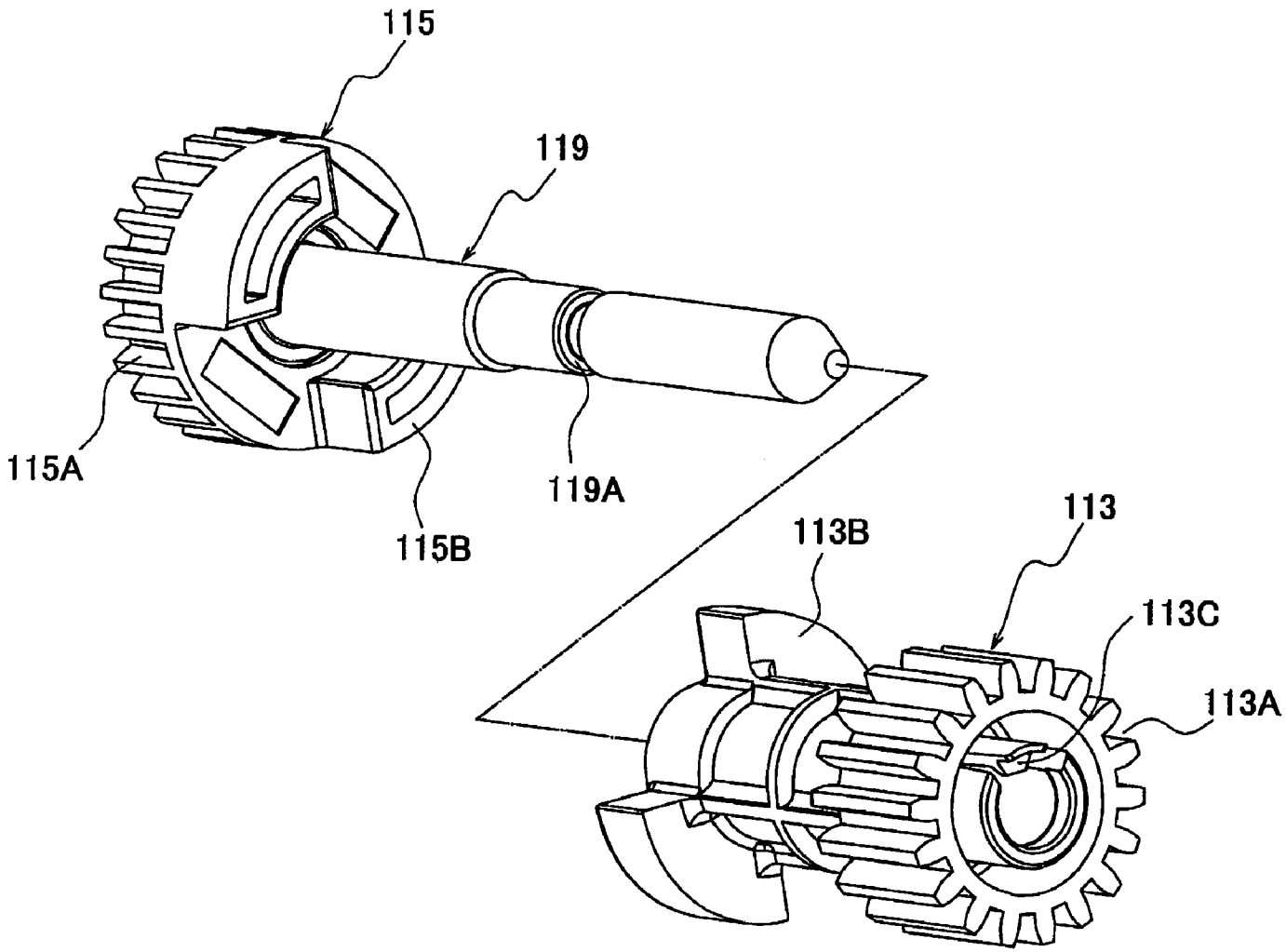
FIG. 8 is an exploded perspective view of the gear mechanism that transmits a driving force to the heat roller.

As shown in FIG. 8, the first intermediate gear 113 is provided with a mating portion such as teeth portion 113A at one end with respect to an axial direction and a coupling portion 113B at the other end. The teeth portion 113A is configured to be coupled (e.g., in mesh) with the heat roller gear 111. The coupling portion 113B is partially fan-shaped, and is configured to be coupled to an engaging portion 115B of a second intermediate gear 115.

The second intermediate gear 115 is provided with a mating portion such as teeth portion 115A and the engaging portion 115B. The teeth portion 115A is configured to be coupled with the drive-side gear 117. The engaging portion 115B is partially fan-shaped to be coupled with the coupling portion 113B of the first intermediate gear 113. As shown in FIG. 6, as the coupling portion 113B and the engaging portion 115B are coupled with each other, the first intermediate gear 113 and the second intermediate gear 115 are disposed coaxially, and thus they rotate integrally.

The gear shaft 119 is configured to rotatably support the first intermediate gear 113 and the second intermediate gear 115. The base end of the gear shaft 119 is fixed to a shaft plate 121 that is fixed to the body frame 100. The tip end of the gear shaft 119 extends from the body frame 100 into the installation space 103, and is supported by a support portion 83 provided to the fixing unit 80.

The shaft plate 121 is made of metal such as steel plate SPCC (JIS standard), located in position by a positioning device (not shown) provided in the body frame 100, and fixed to the body frame 100 with a fastening device such as a screw. The gear shaft 119 is fixed to the shaft plate 121 by partially deforming at least one of the gear shaft 119 and the shaft plate 121.

The support portion 83 is formed with a U-shaped cutout portion 83A at the end. The tip end of the gear shaft 119, which faces toward the installation space 103, is supported in the cutout portion 83A. Thus, although only the base end of the gear shaft 119 is supported, an axis-to-axis distance between the teeth portion 113A and the heat roller 111 can be maintained constant.

Figure 7:
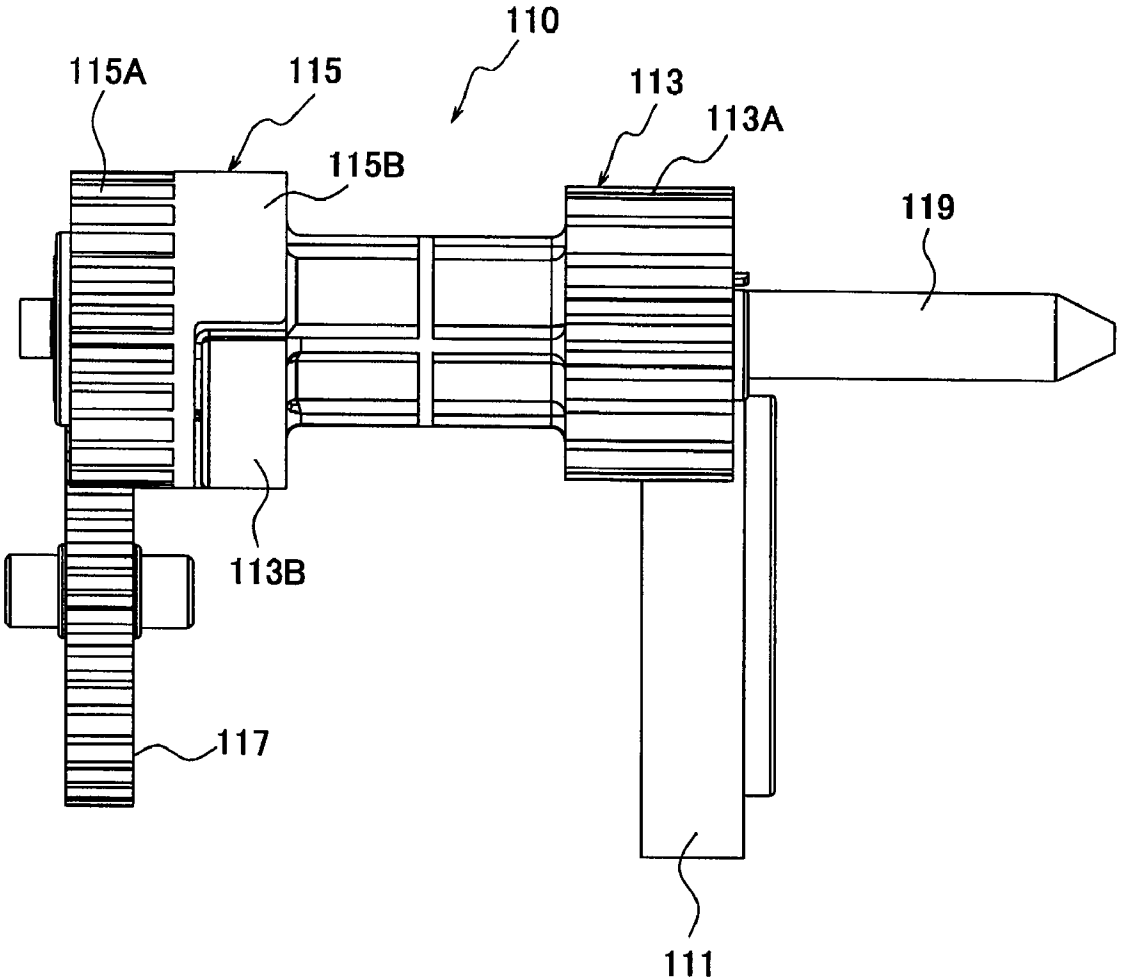
FIG. 7 shows the gear mechanism that transmits a driving force to the heat roller.
Figure 9:
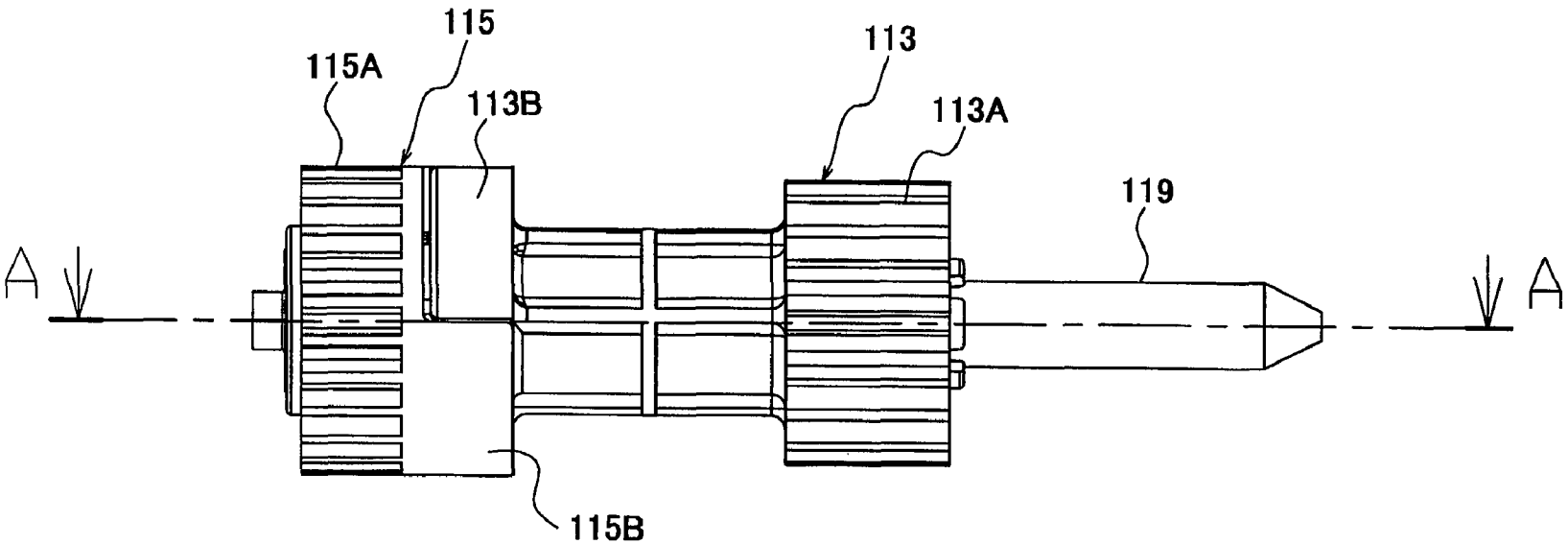
FIG. 9 shows a first intermediate gear, a second intermediate gear, and a gear shaft.

The first intermediate gear 113 and the second intermediate gear 115 are removably assembled to the gear shaft 119 by being inserted from the installation space 103, that is, the tip end of the gear shaft 119, as shown in FIGS. 7 to 9.

Figure 10:
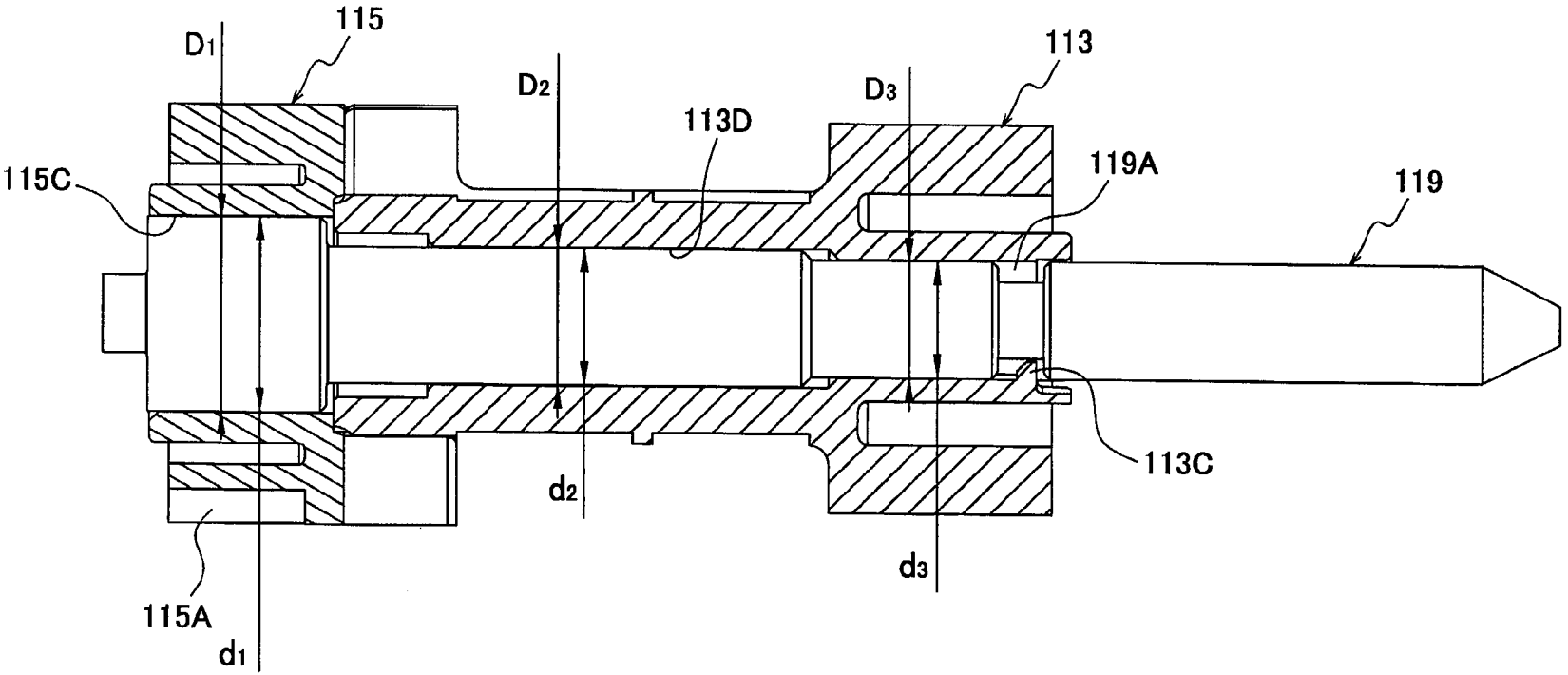
FIG. 10 is a sectional view taken along a line A-A of FIG. 9.

As shown in FIG. 10, the first intermediate gear 113 includes a protruding portion 113C that is elastically displaceable. The protruding portion 113C is disposed so as to engage with an engaging groove 119A formed around the circumference of the gear shaft 119.

By engagement of the engaging groove 119A with the protruding portion 113C, the first intermediate gear 113 is prevented from separating from the gear shaft 119. The second intermediate gear 115 is held between the shaft plate 121 and the first intermediate gear 113, as shown in FIG. 6, and thus prevented from separating from the gear shaft 119.

Thus, when the protruding portion 113C is disengaged from the engaging groove 119A and the first intermediate gear 113 is moved toward the tip end of the gear shaft 119, the second intermediate gear 115 can be also removed from the gear shaft 119 in a manner similar to the first intermediate gear 113.

Conversely, when the first intermediate gear 113 and the second intermediate gear 115 are mounted on the gear shaft 119, the second gear 115 is inserted into the gear shaft 119 from the installation space 103 (or the tip end of the gear shaft 119) to the body frame 100 (or the base end of the gear shaft 119) so that the teeth portion 115A is engaged with the drive-side gear 117, and then the first intermediate gear 113 is inserted into the gear shaft 119 so that the engaging portion 115B is engaged with the coupling portion 113B.

In this illustrative embodiment, when the engaging portion 115B and the coupling portion 113B are coupled, the engaging groove 119A and the protruding portion 113C coincide with each other in position. Thus, when the engaging portion 115B and the coupling portion are coupled, the protruding portion 113C is engaged in the engaging groove 119A.

In the illustrative embodiment, as shown in FIG. 10, the gear shaft 119 is shaped so that its diameter decreases from the body frame 100 (the base end) toward the tip end.

More specifically, d1 denotes a diameter of the gear shaft 119 where the second intermediate gear 115 is fitted, d2 denotes a diameter of the gear shaft 119 which corresponds to the coupling portion 113B of the first intermediate gear 113, and d3 denotes a diameter of the gear shaft 119 which corresponds to the teeth portion 113A of the first intermediate gear 113. The gear shaft 119 is stepped shaped so that its diameter size changes as follows: d1>d2>d3.

In addition, the gear shaft 119 is shaped so as to correspond to a diameter of an insertion hole 115C formed in the second intermediate gear 115 where the gear shaft 119 is to be inserted, and a diameter of an insertion hole 113D formed in the first intermediate gear 113 where the gear shaft 119 is inserted.

More specifically, D1 denotes a diameter of the insertion hole 115C of the second intermediate gear 115, D2 denotes a diameter of the insertion hole 113D of the first intermediate gear 113 which corresponds to the coupling portion 113B, and D3 denotes a diameter of the insertion hole 113D of the first intermediate gear 113 which corresponds to the teeth portion 113A. The diameters D1, D2, and D3 are related as follows: D1>D2>D3.

In the laser printer 1 according to this illustrative embodiment, as the gear shaft 119 is assembled to the body frame 100 via the shaft plate 121, the first intermediate gear 113 and the second intermediate gear 115 are removably assembled to the body frame 100 from the installation space 103.

Figure 5:
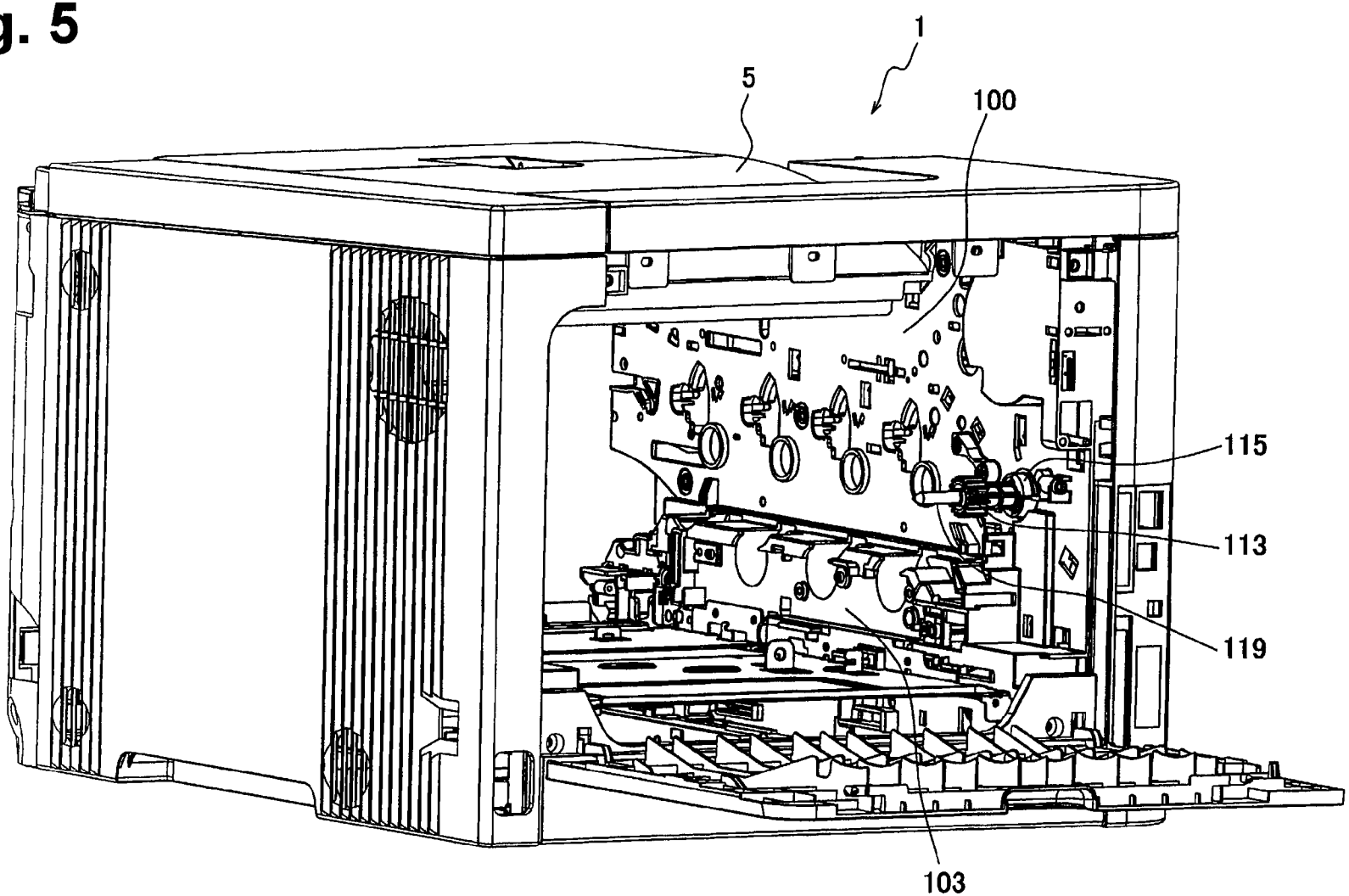
FIG. 5 is a perspective view of the body frame from which the fixing unit is removed.

In the laser printer 1, when the fixing unit 80 is removed from the body frame 100, as shown in FIG. 5, the installation space 103 is opened, and the first intermediate gear 113 and the second intermediate gear 115 can be easily removed from the installation space 103. Thus, the maintainability of the first intermediate gear 113 and the second intermediate gear 115 can be improved.

As the heat roller 81 is heated to high temperature, the heat roller gear 111, which rotates integrally with the heat roller 81, is generally made of a resin reinforced with fiberglass having high strength and hardness, e.g. polyphenylene sulfide (PPS) GF40. Thus, if the hardness of the first intermediate gear 113 directly engaged with the heat roller gear 111 is lower than the hardness of the heat roller gear 111, the first intermediate gear 113 (the teeth portion 113A) is liable to be worn or damaged at an early stage.

Conversely, if the first intermediate gear 113 is made of a material excellent in strength and hardness (e.g. metal) as with the heat roller gear 111, the first intermediate gear 113 (the teeth portion 113A) may be prevented from getting worn or damaged at an early stage but it may cause the manufacturing cost of the first intermediate gear 113 to increase.

In the illustrative embodiment, the first intermediate gear 113 is made of a resin such as polyamide (PA) and polybutylene terephthalate (PBT), and it is difficult to prevent the first intermediate gear 113 from getting worn or damaged at an early stage. However, the first intermediate gear 113 is designed for easy replacement as described above. If the first intermediate gear 113 is replaced at the same time of replacing the fixing unit 80, problems with the first intermediate gear 113 can be prevented from occurring even when the first intermediate gear 113 is made of PA or PBT.

Thus, in the laser printer 1 according to the illustrative embodiment, increased manufacturing cost is suppressed by improving the maintainability of the first intermediate gear 113, and problems with the first intermediate gear 113 can be prevented from occurring.

Two coupling or meshing gears make sliding contact with each other at their teeth, and thus teeth are liable to wear. To prevent wearing of the teeth, the hardness of teeth needs to be increased. However, if the gears were made of metal or reinforced resin to increase their hardness, it may cause the manufacturing cost of the gears or the entire laser printer 1 to increase.

In the laser printer 1, the second intermediate gear 115 transmits a driving force to the first intermediate gear 113 via the coupling portion 113B of the first intermediate gear 113 and the engaging portion 115B of the second intermediate gear 115, which are coupled. Thus, the coupling portion 113B of the first intermediate gear 113 hardly slides against the engaging portion 115B, and the wearing generating between the coupling portion 113B of the first intermediate gear 113 and the engaging portion 115B is hard to accelerate.

Thus, the material used (or hardness required) for the first intermediate gear 113 should be durable enough to last until the fixing unit 80 is replaced. However, even when the second intermediate gear 115 and the drive-side gear 117 are made of a resin, e.g. polyacetal (POM) in this illustrative embodiment, which is relatively low in hardness and manufacturing cost than the materials used for the first intermediate gear 113 and the heat roller gear 111, problems with the second intermediate gear 115 and the drive-side gear 117 such as wear and damage at an early stage can be suppressed.

Without increasing the manufacturing cost of the laser printer 1, adequate materials can be used for the heat roller gear 111, the first intermediate gear 113, the second intermediate gear 115, and the drive-side gear 117.

In one illustrative aspect, hardness of each gear is set as follows: the heat roller gear 111>the first intermediate gear 113>the second intermediate gear 115>the drive-side gear 117.

As the first intermediate gear 113 is provided with the protruding portion 113C to be coupled with the gear shaft 119, the first intermediate gear 113 is prevented from separating from the gear shaft 119 while each gear rotates.

The gear shaft 119 may be formed with a step-like structure so that its diameter is greater at the base end than at the tip end. To correspond to the gear shaft 119, the insertion hole 113D of the first intermediate gear 113 is shaped so that its diameter is greater at the coupling portion 113B than at the teeth portion 113A. Thus, in one aspect the first intermediate gear 113 can be designed so that it can be mounted on the gear shaft 119 in only one direction.

According to this aspect, an error in which the first intermediate gear 113 is assembled to the gear shaft 119 in an improper direction can be prevented from occurring. Thus, the maintainability of the first intermediate gear 113 can be improved.

The base end of the gear shaft 119 is fixed to the body frame 100, and the fixing unit 80 is removably assembled to the body frame 100. According to the positional accuracy of the fixing unit 80, the position of the first intermediate gear 113 relative to the heat roller gear 111 may change, that is, the distance or pitch between the heat roller gear 111 and the first intermediate gear 113 may change significantly.

If the distance between the heat roller gear 111 and the first intermediate gear 113 significantly changes, the heat roller gear 111 and the first intermediate gear 113 can not properly engage with each other. As a result, a driving force may not be reliably transmitted from the first intermediate gear 113 to the heat roller gear 111.

In response, an illustrative embodiment provides the fixing unit 80 with the support portion 83. With the fixing unit 80 attached to the body frame 100, the gear shaft 119 is supported at both ends as it is fixed to the body frame 100 at the base end, and supported by the support portion 83 at the tip end.

Thus, since the fluctuations in the distance between the heat roller gear 111 and the first intermediate gear 113 can be reduced, a driving force can be reliably transmitted from the first intermediate gear 113 to the heat roller gear 111.

In the above illustrative embodiment, the invention is applied to the gear mechanism that transmits a driving force to the heat roller 81. However, the invention is not limited to the gear mechanism, and is applicable to, for example, a gear mechanism that transmits a driving force to another roller.

In the above described illustrative embodiment, the invention is applied to a color tandem laser printer, the invention is not so limited, and may be applied to other image forming apparatuses such as a monochrome laser printer.

In the above embodiment, the first intermediate gear 113 receives a driving force from the drive-side gear 117 via the second intermediate gear 115. However, the invention is not so limited. The use of the second intermediate gear 115 may be abolished and the first intermediate gear 113 may be directly engaged with the drive-side gear 117.

In the above embodiment, the first intermediate gear 113 is prevented from separating from the gear shaft 119 by engagement of the engaging groove 119A with the protruding portion 113C. However, the invention is not so limited. For example, the first intermediate gear 113 may be prevented from separating from the gear shaft 119 using a cotter pin or cap.

In the above illustrative embodiment, the gear shaft 119 is configured so that its diameter is greater at the base end than at the tip end in a stepped manner. However, the invention is not limited to such a configuration. For example, the diameter of the gear shaft 119 may be continuously changed so that it is greater at the base end than at the tip end. Alternatively, the diameter of the gear shaft 119 may be invariant from the base end to the tip end.

In the above illustrative embodiment, the fixing unit 80 is provided with the support portion 83. However, the invention is not so limited and may be implemented without the support portion 83.

In the above illustrative embodiment, the gear shaft 119 is assembled to the body frame 100 via the shaft plate 121. However, the invention is not so limited. For example, the gear shaft 119 may be fixed directly to the body frame 100.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the illustrative embodiment and examples of modifications disclosed herein are only exemplary and the scope of the invention is not so limited thereby, but is to be determined by the claims which follow.

What is claimed is:

1. An image forming apparatus comprising:

a main body including a body frame and a gear shaft, the body frame defining an installation space therein and the gear shaft extending from the body frame into the installation space;

an image forming device configured to form an image on a recording medium, the image forming device including a unit that is disposed in the installation space and configured to be attached to and removed from the body frame, the unit including:

a support portion configured to engage the gear shaft when the unit is attached to the body frame and to disengage from the gear shaft when the unit is removed from the body frame;

a rotating member configured to rotate upon receipt of a driving force; and a unit-side gear configured to rotate together with the rotating member; and a first intermediate gear configured to transmit the driving force to the unit-side gear, the first intermediate gear configured to be attached to and removed from the gear shaft in the installation space when the unit is removed from the main body.

2. The image forming apparatus according to claim 1, further comprising:

a drive-side gear disposed on the body frame; and a second intermediate gear configured to transmit a driving force from the drive-side gear to the first intermediate gear, wherein the first intermediate gear is provided with a coupling portion at an end with respect to an axial direction, the second intermediate gear is provided with a mating portion and an engaging portion, the mating portion is configured to be coupled with the drive-side gear, and the engaging portion is configured to be coupled with the coupling portion of the first intermediate gear.

3. The image forming apparatus according to claim 2, wherein the first and second intermediate gears are mounted on the gear shaft and removably assembled to the body frame.

4. The image forming apparatus according to claim 3, wherein the first intermediate gear is provided with a protruding member configured to engage with the gear shaft.

5. The image forming apparatus according to claim 3, wherein a diameter of the gear shaft at the base end is greater than a diameter of the gear shaft toward a tip end away from the body frame.

6. The image forming apparatus according to claim 1, wherein the unit-side gear and the first intermediate gear are made of a resin, and a hardness of the first intermediate gear is less than or equal to a hardness of the unit-side gear.

7. The image forming apparatus according to claim 1, wherein the gear shaft includes a recessed portion formed on a circumference of the gear shaft, and the first intermediate gear includes a protruding portion that is configured to engage in the recessed portion of the gear shaft when the first intermediate gear is attached to the gear shaft.

8. The image forming apparatus according to claim 1, wherein the support portion is formed with a U-shaped portion.

9. The image forming apparatus according to claim 1, wherein the support portion is formed with a U-shaped cutout portion and the gear shaft is inserted into the U-shaped cutout portion in a direction perpendicular to an axis of the gear shaft.

10. The image forming apparatus according to claim 1, wherein the rotating member includes a heat roller configured to heat a developing agent image transferred onto a recording medium while rotating upon receipt of the driving force.

11. An electrophotographic image forming apparatus configured to form an image on a recording medium by transferring a developing agent image onto the recording medium, the image forming apparatus comprising:

a body frame defining an installation space therein;

a unit including a heat roller configured to heat a developing agent image transferred onto a recording medium while rotating upon receipt of a driving force from the body frame, the unit configured to be attached to and removed from the body frame, the unit including a unit-side gear; and a first intermediate gear configured to transmit the driving force from the body frame to the unit-side gear, the first intermediate gear configured to be attached to and removed from the body frame in the installation space where the unit is disposed, wherein the unit-side gear is configured to mesh with the first intermediate gear and transmit the driving force from the first intermediate gear to the heat roller when the heat unit is attached to the body frame, and is configured to disengage from the first intermediate gear when the unit is removed from the body frame.

12. The image forming apparatus according to claim 11, further comprising a drive-side gear disposed on the body frame; and a second intermediate gear configured to transmit a driving force from the drive-side gear to the first intermediate gear, wherein the first intermediate gear is provided with a coupling portion at an end with respect to an axial direction, the second intermediate gear is provided with a mating portion and an engaging portion, the mating portion is coupled with the drive-side gear, and the engaging portion is disposed in engagement with the coupling portion of the first intermediate gear.

13. The image forming apparatus according to claim 12, wherein the body frame is coupled to a gear shaft at a base end, the gear shaft extending into the installation space, and the first and second intermediate gears are mounted on the gear shaft and removably assembled to the body frame.

14. The image forming apparatus according to claim 13, wherein the first intermediate gear is provided with a protruding member configured to engage with the gear shaft.

15. The image forming apparatus according to claim 13, wherein a diameter of the gear shaft at the base end is greater than a diameter of the gear shaft toward a tip end away from the body frame.

16. The image forming apparatus according to claim 13, wherein the unit includes a support portion that is configured to support the gear shaft at a tip end opposite to the base end.

17. The image forming apparatus according to claim 13, wherein the gear shaft includes a recessed portion formed on a circumference of the gear shaft, and the first intermediate gear includes a protruding portion that is configured to engage in the recessed portion of the gear shaft when the first intermediate gear is attached to the gear shaft.

18. The image forming apparatus according to claim 13, wherein the support portion is formed with a U-shaped portion.

19. The image forming apparatus according to claim 11, wherein the unit-side gear and the first intermediate gear are made of a resin, and a hardness of the first intermediate gear is less than or equal to a hardness of the unit-side gear.

* * * * *